US009850601B2

(12) United States Patent
Shen et al.

(10) Patent No.: US 9,850,601 B2
(45) Date of Patent: Dec. 26, 2017

(54) KNITTED ATHLETIC PERFORMANCE GARMENT

(71) Applicant: Reebok International Limited, London (GB)

(72) Inventors: Hongqing Shen, Weymouth, MA (US); Marc Leonardo, Millis, MA (US); Ryan J. Catalano, Marshfield, MA (US); Christopher Gallo, Plymouth, MA (US)

(73) Assignee: Reebok International Limited, London (GB)

( * ) Notice: Subject to any disclaimer, the term of this patent is extended or adjusted under 35 U.S.C. 154(b) by 1156 days.

(21) Appl. No.: 13/919,540

(22) Filed: Jun. 17, 2013

(65) Prior Publication Data

US 2014/0366585 A1 Dec. 18, 2014

(51) Int. Cl.
*D04B 21/20* (2006.01)
*A41D 13/00* (2006.01)

(52) U.S. Cl.
CPC ..... *D04B 21/207* (2013.01); *A41D 13/0015* (2013.01); *A41D 2500/10* (2013.01); *D10B 2501/021* (2013.01)

(58) Field of Classification Search
CPC ..... D04B 21/08; D04B 21/21; D04B 21/207; D04B 21/18
See application file for complete search history.

(56) References Cited

U.S. PATENT DOCUMENTS 2,026,963 A * 1/1936 Burns ..... A41C 1/02 450/116
2,074,119 A * 3/1937 Boysen ..... D04B 21/20 2/402
2,411,175 A * 11/1946 Wagler ..... D04B 21/18 2/DIG. 9
3,487,662 A * 1/1970 Safrit ..... A41B 11/12 2/240
3,590,603 A * 7/1971 Jackson ..... D04B 21/207 2/409
3,673,820 A * 7/1972 Sarmiento ..... A41B 9/04 450/104
3,685,319 A * 8/1972 Jackson ..... D04B 21/207 66/176
3,703,820 A * 11/1972 Jackson ..... A41C 1/02 66/177

(Continued)

*Primary Examiner* — Danny Worrell
(74) *Attorney, Agent, or Firm* — Sterne, Kessler, Goldstein & Fox P.L.L.C.

(57) ABSTRACT

A knitted athletic performance garment includes a seamless panel to cover a portion of a wearer's body, a first performance zone and a second performance zone formed in the seamless panel, wherein the first performance zone is formed of a first warp knit stitch construction and has a first modulus, wherein the second performance zone is formed of a second warp knit stitch construction and has a second modulus, wherein the first warp knit stitch construction is different from the second warp knit stitch construction, wherein the first modulus is different from the second modulus, and wherein the difference in modulus between the first performance zone and the second performance zone is due to the difference in stitch construction between the first performance zone and the second performance zone.

18 Claims, 15 Drawing Sheets

(56) References Cited

U.S. PATENT DOCUMENTS 3,710,599 A * 1/1973 Sarmiento ..... D04B 21/00 66/193
3,824,812 A * 7/1974 Matthews ..... A41B 9/08 2/409
3,931,721 A * 1/1976 Adamson ..... D04B 21/18 66/195
4,044,575 A * 8/1977 Krug ..... D04B 21/18 66/190
4,048,818 A * 9/1977 Cueman ..... D04B 1/265 66/172 E
4,086,790 A * 5/1978 Hanrahan, Jr. ..... D04B 1/265 66/178 A
4,502,301 A * 3/1985 Swallow ..... A61F 13/08 602/62
4,538,615 A * 9/1985 Pundyk ..... A41C 1/003 450/131
5,255,393 A * 10/1993 Brady ..... A41D 1/20 2/409
5,611,722 A * 3/1997 Osborne ..... A41B 9/04 2/401
5,974,592 A * 11/1999 Tabrizi ..... A41B 9/02 2/400
6,047,406 A 4/2000 Dicker et al.
6,223,782 B1 * 5/2001 Watkins ..... A41D 13/12 139/383 R
6,276,175 B1 * 8/2001 Browder, Jr. ..... A41B 9/001 2/409
6,276,177 B1 * 8/2001 West ..... D04B 21/12 442/306
6,401,497 B1 * 6/2002 Nishiyama ..... A41B 9/04 66/171
6,691,535 B2 * 2/2004 Gotta ..... D04B 21/06 66/172 E
6,886,367 B2 5/2005 Mitchell et al.
7,017,376 B2 3/2006 Meckley et al.
7,043,329 B2 5/2006 Dias et al.
7,048,013 B2 * 5/2006 Shannon ..... A41B 9/001 139/421
7,441,418 B2 * 10/2008 Delgado-Mecinas .... A41B 9/00 66/169 R
7,509,822 B2 * 3/2009 Ishida ..... A63B 21/4025 2/401
7,631,521 B2 * 12/2009 Oya ..... D04B 21/18 66/172 E
7,636,950 B2 12/2009 Melhart et al.
8,028,547 B2 * 10/2011 Suzuki ..... D04B 21/08 66/192
8,296,864 B2 * 10/2012 Torry ..... A41D 1/08 2/69
8,381,314 B2 * 2/2013 Takamoto ..... A41D 7/00 2/243.1
8,726,700 B2 * 5/2014 Waldman ..... D04B 21/18 66/171
9,149,076 B2 * 10/2015 Almog ..... A41C 3/12
2010/0299799 A1 12/2010 Belluye et al.
2014/0366585 A1 * 12/2014 Shen ..... A41D 13/0015 66/175

* cited by examiner

KNITTED ATHLETIC PERFORMANCE GARMENT

BACKGROUND

Field

Embodiments of the present invention relate to athletic performance garments. Specifically, embodiments of the present invention relate to warp-knitted athletic performance garments having areas of differing characteristics within the same seamless panel.

Background

Physical activity is important to maintaining a healthy lifestyle and individual well-being. There are many activities in daily life that require individuals to use their strength, agility, posture, and balance, and maintaining physical fitness can help individuals complete these activities with minimum disruption to their lives. Maintaining physical fitness has also been shown to strengthen the heart, boost HDL cholesterol, aid the circulatory system, and lower blood pressure and blood fats, translating to lower risk for heart disease, heart attack, and stroke. Physical activity also strengthens muscles, increases flexibility, and promotes stronger bones, which can help prevent osteoporosis.

Performance apparel may be worn by a wearer during periods of athletic activity. For example, while running, swimming, or playing a sport. Such activity may involve substantial energy expenditure, relative movement of limbs and other body parts, and perspiration. Such motion is typically intended to be optimized to achieve a goal (e.g., running or swimming a target distance and/or speed). Performance apparel may be designed not to impede such motion, or even to enhance it. Performance apparel may also be worn after an activity, for example, to assist a wearer's muscles in recovering more quickly after exercise. Garments are known that purport to assist a user in achieving a variety of fitness goals, including increasing muscle activation in desired locations. However, existing garments often suffer from problems such as poor functionality, uncomfortable fit, high cost, and undesirable aesthetics.

BRIEF SUMMARY

At least some of the embodiments of the present invention satisfy the above needs and provide further related advantages as will be made apparent by the description that follows.

Some embodiments of the present invention provide a knitted athletic performance garment including a seamless panel to cover a portion of a wearer's body, and a first performance zone and a second performance zone formed in the seamless panel, wherein the first performance zone is formed of a first warp knit stitch construction and has a first modulus, wherein the second performance zone is formed of a second warp knit stitch construction and has a second modulus, wherein the first warp knit stitch construction is different from the second warp knit stitch construction, wherein the first modulus is different from the second modulus, and wherein the difference in modulus between the first performance zone and the second performance zone is due to the difference in stitch construction between the first performance zone and the second performance zone.

Some embodiments of the present invention provide an athletic performance garment including a knitted high-power zone having a high-power knit construction, and a knitted low-power zone having a low-power knit construction, wherein the high-power zone and low-power zone are seamlessly formed together in a flat pattern, and wherein an average underlap of the high-power zone is longer than an average underlap of the low-power zone.

Some embodiments of the present invention provide an athletic performance garment including a knitted high-power zone having a high-power knit construction, and a knitted low-power zone having a low-power knit construction, wherein the high-power zone and low-power zone are seamlessly formed together in a flat pattern, and wherein an average stitch angle of the high-power zone is smaller than an average stitch angle of the low-power zone.

Additional features of embodiments of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE FIGURES

The accompanying figures, which are incorporated herein, form part of the specification and illustrate embodiments of the present invention. Together with the description, the figures further serve to explain the principles of and to enable a person skilled in the relevant arts to make and use the invention.

DETAILED DESCRIPTION

Figure 1A:
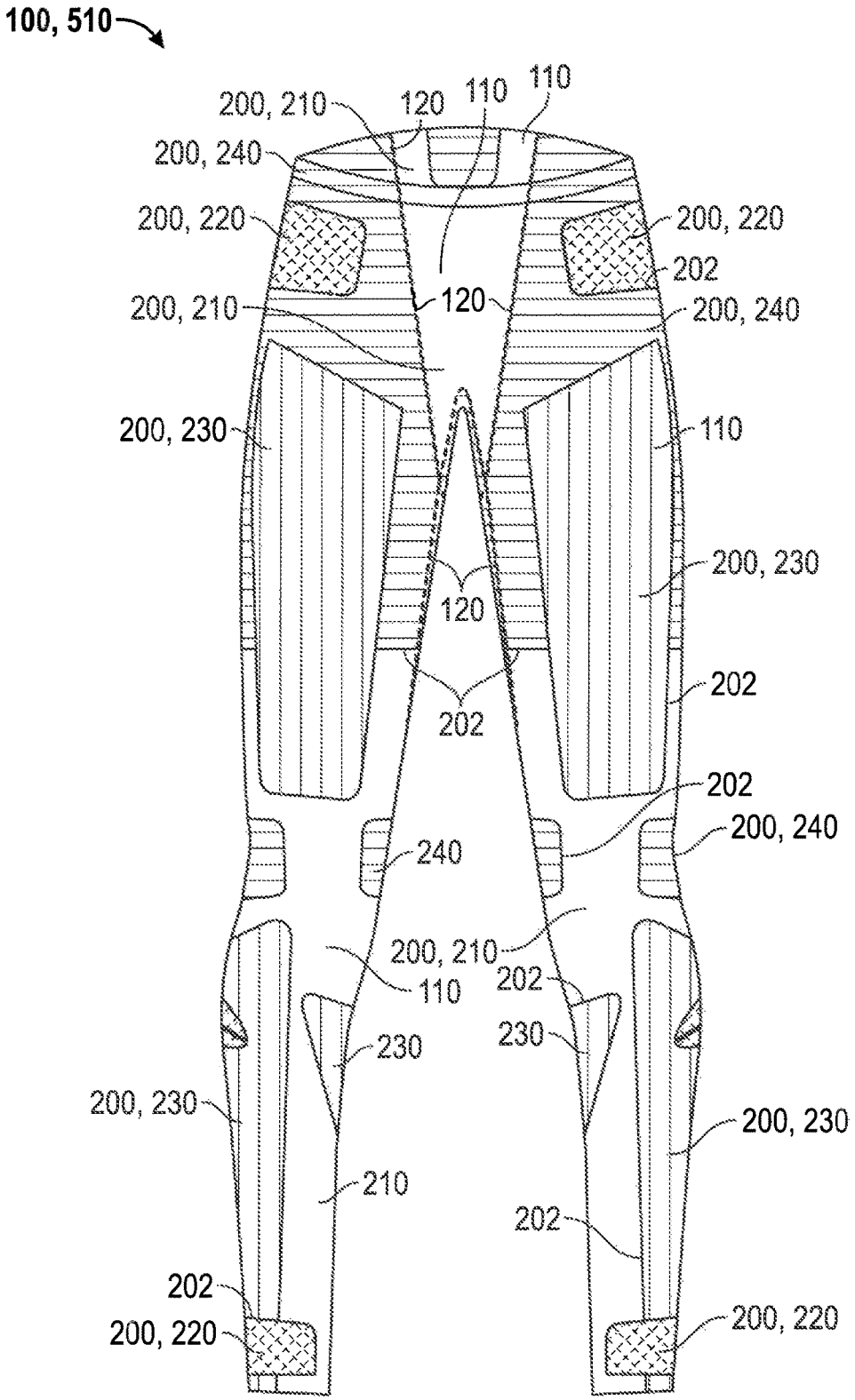
FIG. 1A illustrates a front view of a knitted athletic performance garment, according to embodiments presented herein.

Embodiments of the present invention will now be described in detail with reference to embodiments thereof as illustrated in the accompanying drawings, in which like reference numerals are used to indicate identical or functionally similar elements. References to an "embodiment" indicate that the embodiment described may include a particular feature, structure, or characteristic, but every embodiment may not necessarily include the particular feature, structure, or characteristic. Moreover, descriptions of embodiments do not necessarily refer to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Performance apparel according to some embodiments of the present invention may fit a wearer in close contact with the wearer's skin, and may in some cases be worn under other apparel. In this way, the apparel can provide performance benefits to the wearer. For example, the close fit of an article of performance apparel may help minimize wind resistance, minimize flapping of apparel material, maintain proper position of the apparel relative to areas of the wearer's body, minimize uncomfortable movement of some parts of a wearer's body relative to other parts of the wearer's body, wick away perspiration, provide compressive force, and facilitate muscle movement by storing and releasing elastic energy in response to wearer motion.

In some embodiments of the present invention, performance apparel may have different performance characteristics at different zones relative to the body of a wearer. For example, performance apparel may apply relatively higher compression to relatively larger muscle groups, may apply relatively lower compression to relatively smaller muscle groups, and may provide relatively high ventilation to areas of the body that generate relatively high heat and sweat.

In some embodiments of the present invention, apparel may be formed from a number of discrete seamless textile panels joined together at seams (e.g., by fusion, gluing, sewing, stapling, or heat-bonding, usually near the edges of the panels). For instance, textile panels of different performance characteristics may be joined together at their edges to form a finished article. In some embodiments of the present invention seams are minimized in a performance apparel garment by forming the garment of seamless textile panels that themselves include multiple zones having different performance characteristics. As performance apparel may be tight fitting, minimizing seams between textile panels of different performance characteristics may help to eliminate discomfort to a wearer (e.g., from scratching or chafing due to seams). In other words, within each textile panel there may be at least two zones having different performance characteristics, with no seam therebetween. For example, a textile panel forming a portion of a garment according to an embodiment of the present invention may include no seams between zones having different performance characteristics. In this way, multiple zones having different performance characteristics may be integrally and continuously manufactured in a seamless panel, thereby simplifying garment manufacture by minimizing the number of separate panels that must be sewn or otherwise connected together to form the finished garment.

Figure 1B:
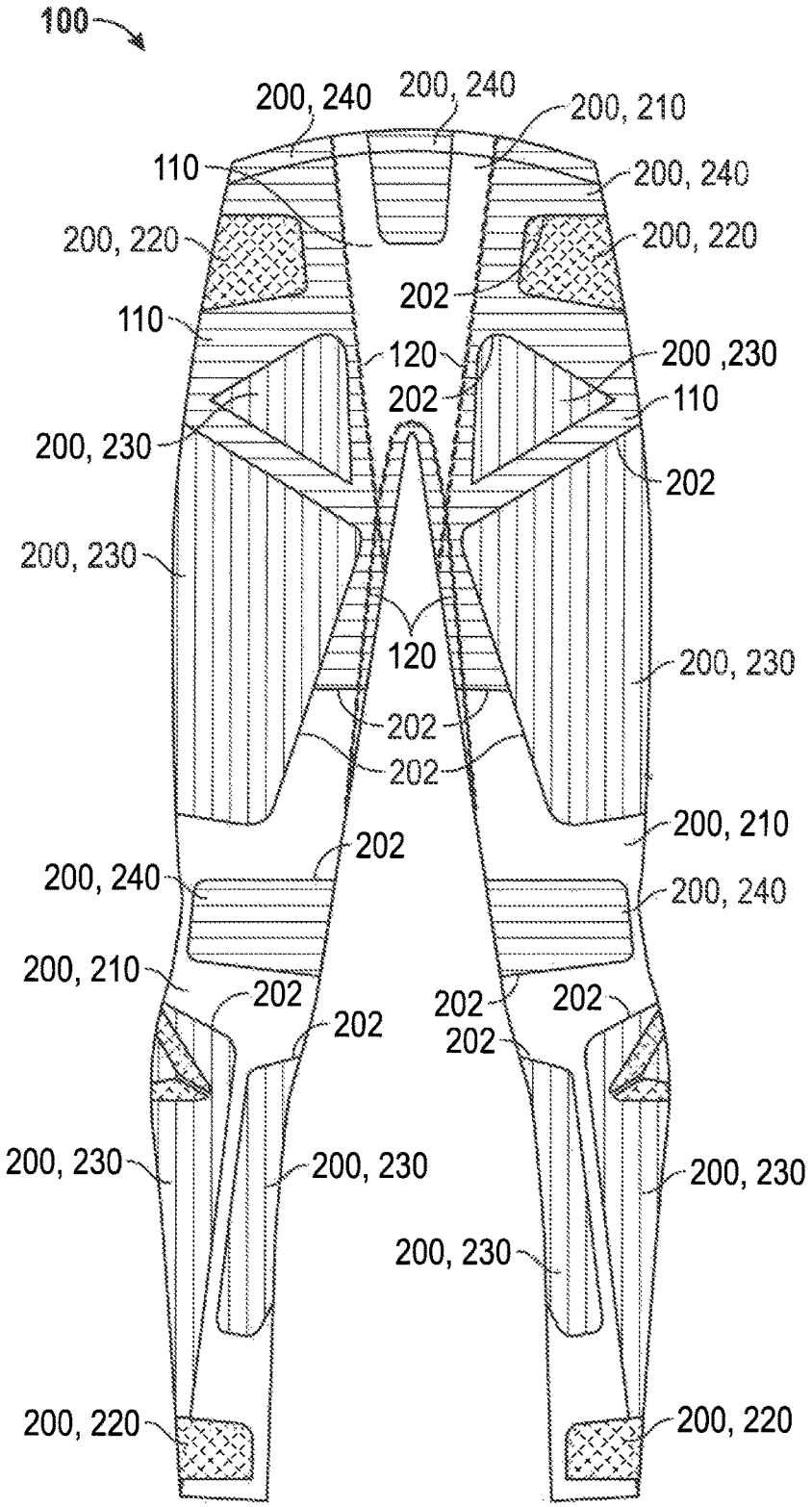
FIG. 1B illustrates a rear view of the knitted athletic performance garment of FIG. 1A, according to embodiments presented herein.
Figure 11A:
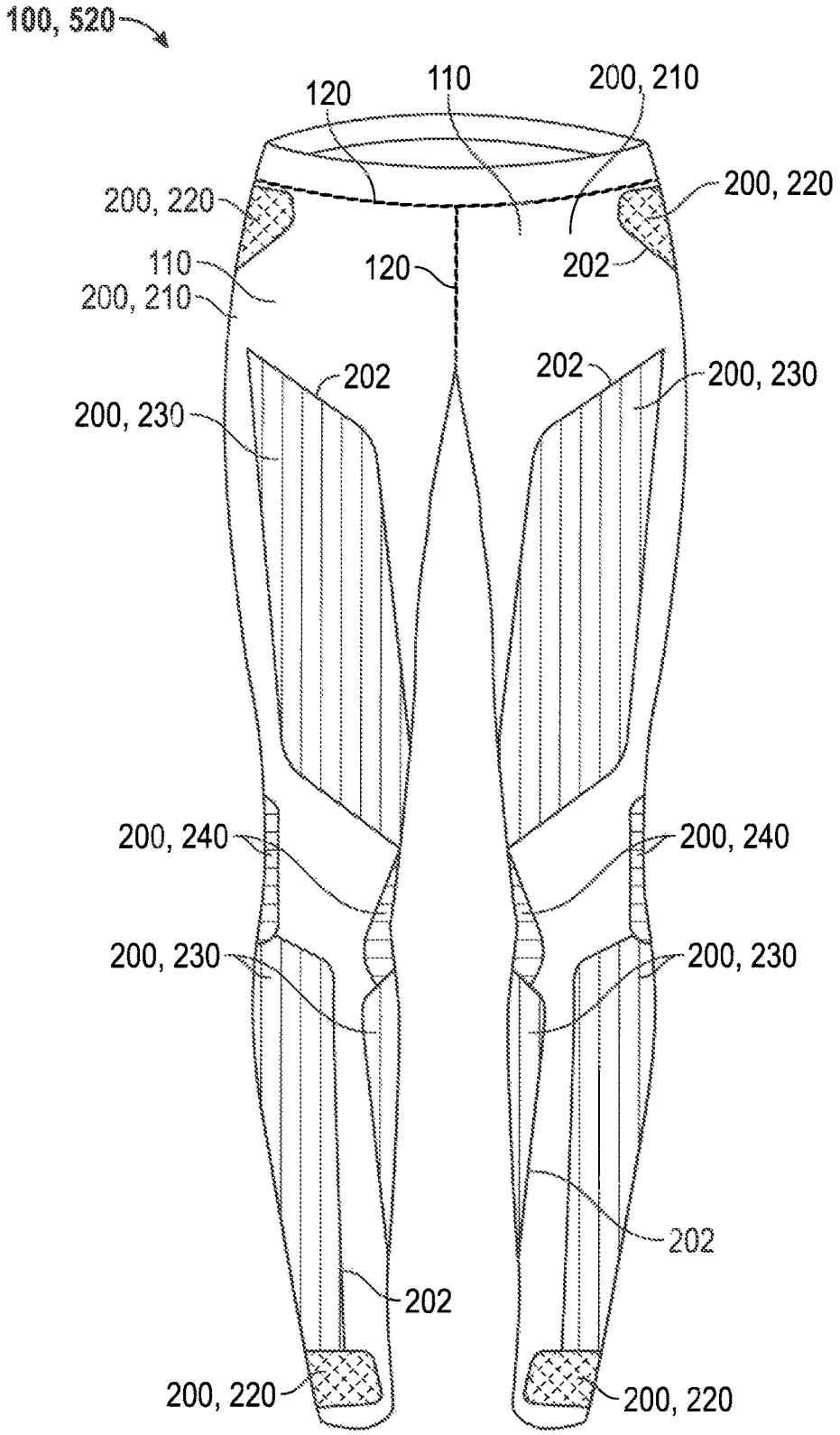
FIG. 11A illustrates a front view of a knitted athletic performance garment, according to embodiments presented herein.
Figure 11B:
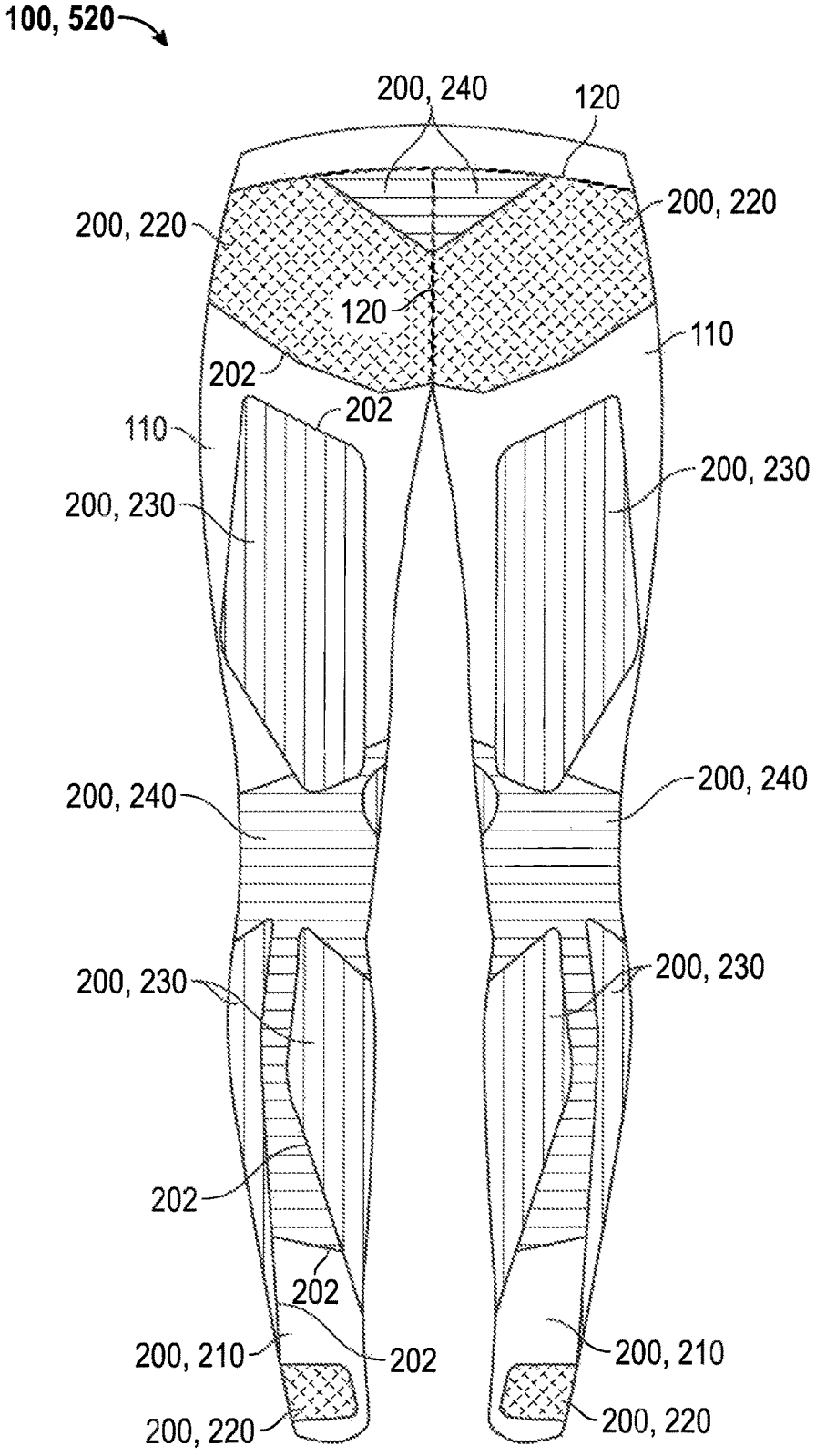
FIG. 11B illustrates a rear view of the knitted athletic performance garment of FIG. 11A, according to embodiments presented herein.
Figure 11C:
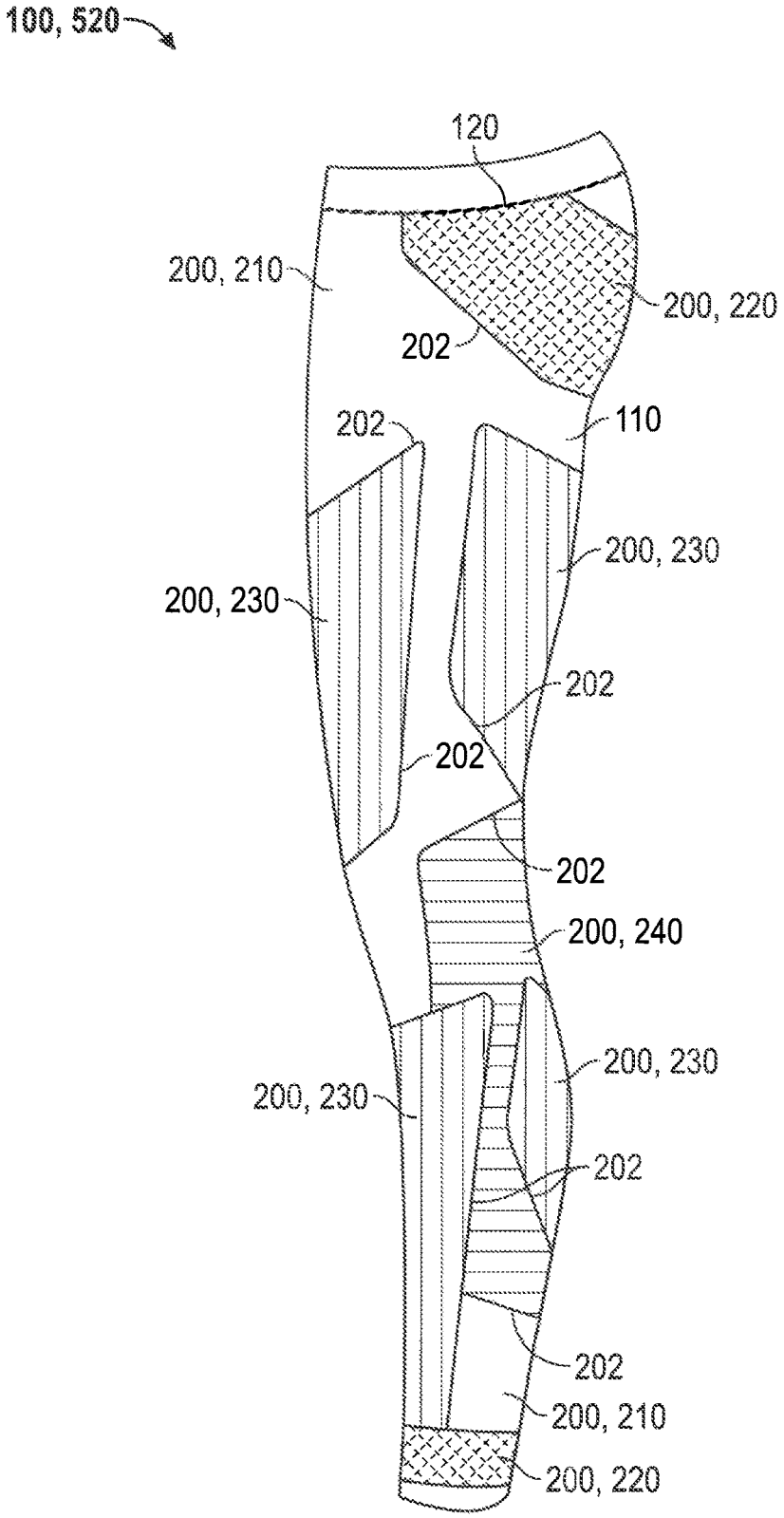
FIG. 11C illustrates a side view of the knitted athletic performance garment of FIG. 11A, according to embodiments presented herein.
Figure 14B:
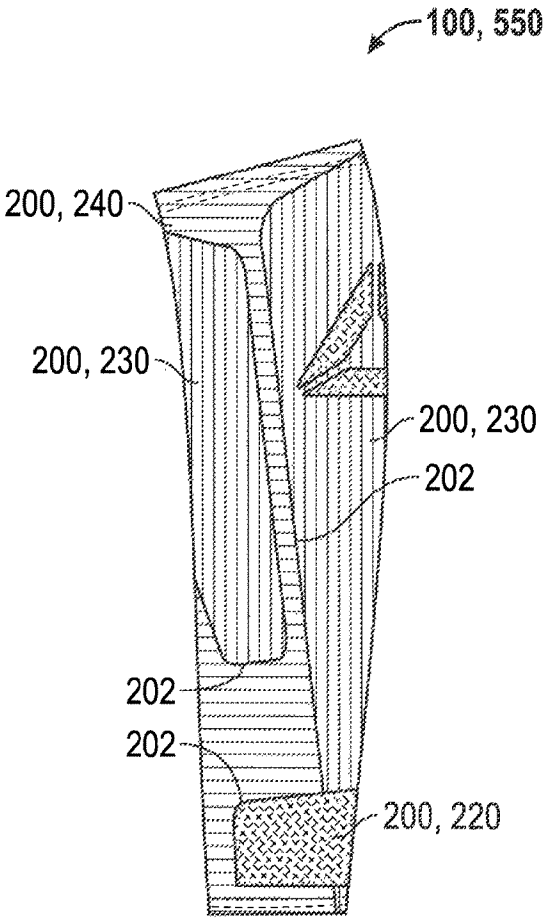
FIG. 14B illustrates a front view of the knitted athletic performance garment of FIG. 14A, according to embodiments presented herein.
Figure 14A:
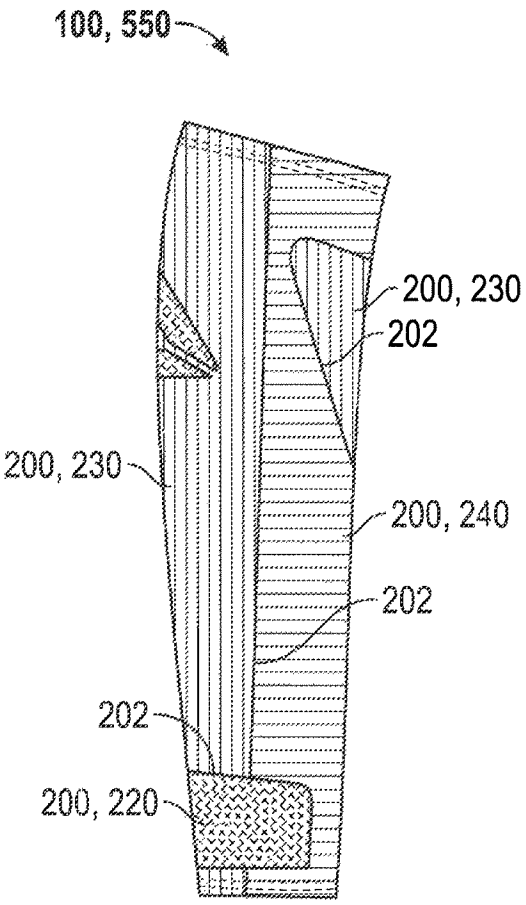
FIG. 14A illustrates a rear view of a knitted athletic performance garment, according to embodiments presented herein.

A knitted garment 100 according to an embodiment of the present invention may be constructed of a plurality of seamless panels 110. For example, knitted garment 100 as depicted in FIGS. 1A and 1B is a pair of pants 510, and includes four seamless panels 110 to cover portions of a wearer's body: one for each leg, and one each for the front and back of the midsection. Other exemplary knitted garments are depicted in FIGS. 11A-11C (pants 520), 12A and 12B (shirt 530), 13A and 13B (shirt 540), and FIGS. 14A and 14B (leg sleeves 550). The sizes, shapes, numbers, and types of seamless panels 110 may be varied to suit the desires of a designer, and are not limited to those depicted. For example, an entire garment may be formed of a single seamless panel 110, or only two panels with a seam therebetween. Further, in some embodiments the seamless panel may include an opening or void therethrough, for example to expose a portion of a wearer's body or to facilitate airflow and cooling.

Each seamless panel 110 may include one or a plurality of performance zones 200 having different performance characteristics (e.g., modulus, ventilation). For example, a single seamless panel 110 may include two or more of a low-power zone 210, a medium-power zone 220, a high-power zone 230, and a ventilation zone 240. In some embodiments performance zones 200 of different types may be differently-colored, and performance zones 200 of the same type may be similarly-colored (e.g., to facilitate identification of performance zone type, and/or for aesthetic purposes). The different colors may be applied to the knitted garment 100 (or a knitted garment pattern 102) by, for example, a dyeing or printing process.

Figure 2:
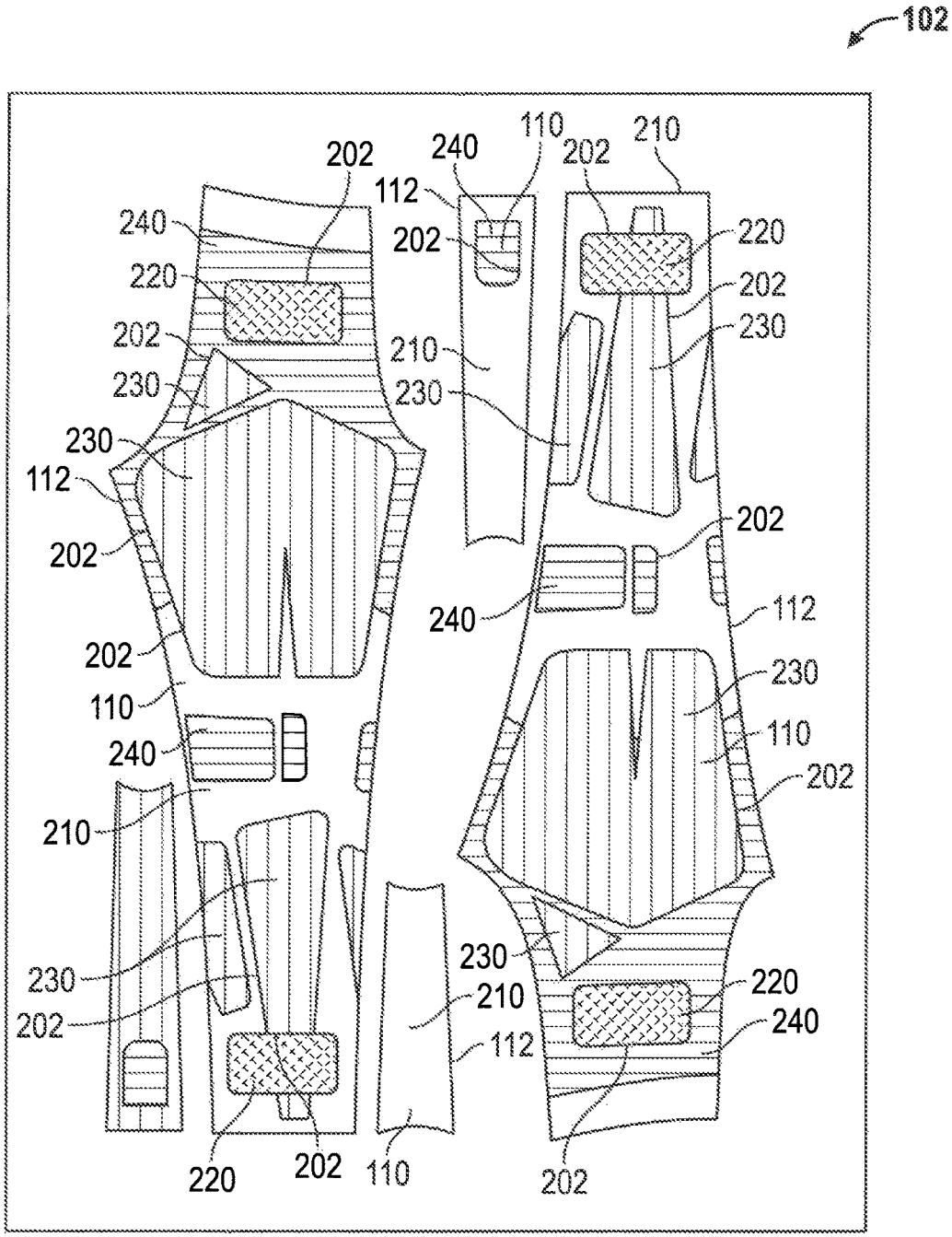
FIG. 2 illustrates a front view of a knitted athletic performance garment pattern, according to embodiments presented herein.

Knitted garment 100 may be constructed from garment pattern 102 (see FIG. 2). Knitted garment pattern 102 may be seamlessly formed in a continuous warp knitting process (e.g., by a warp knitting machine) and may be knit in flat patterns as shown. Warp knitting may impart a flatter, closer, better elastic recovery character to its textile, and may be more durable or more powerful than other forms of knitting. This can increase the configurability and control of performance and ventilation characteristics of performance zones 200 of seamless panels 110 through selective use of different warp knit stitch types, as will be described.

In some embodiments, each performance zone within seamless panel 110 is continuously knitted together with other performance zones 200. In this way performance zones 200 of a seamless panel 110 are continuously formed, without seams between different performance zones 200 of the same seamless panel 110. Each seamless panel 110 may be cut from knitted garment pattern 102 along its panel edge 112. Panel edges 112 (see FIG. 2) of cut seamless panels 110 may be joined together to form garment seams 120 (see FIG. 1), thereby forming knitted garment 100. Garment seams 120 may be formed in any size, shape, pattern, form, or design desired by a designer, and are not limited to the seams 120 depicted. As used herein in reference to seamless panels 110, "seamless" does not preclude seamless panels 110 from forming seams along their panel edges 112 with other panel edges 112 or from having edge stitching along uncoupled free edges thereof, but conveys the absence of seams within seamless panels 110 individually.

Figure 10:
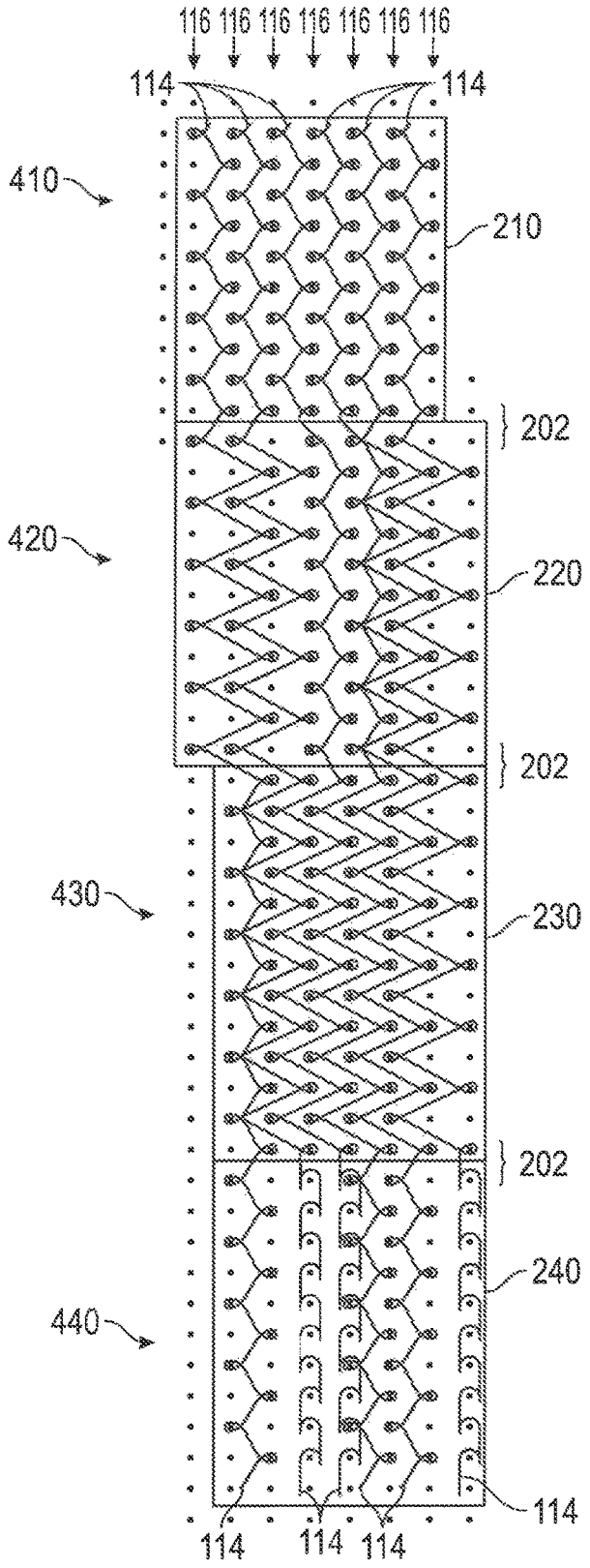
FIG. 10 illustrates continuous knit construction of different performance zones in a seamless knitted panel according to embodiments presented herein.

To maintain textile continuity between different performance zones 200 of a seamless panel 110, a knit construction of textile fibers 114 forming seamless panel 110 may change at a transition 202 between different performance zones 200 (see, e.g., FIGS. 1, 2, and 10). This avoids a seam at transition 202. For example, textile fibers 114 of a seamless panel 110 may form low-power zone 210 of a low-power knit construction 410, medium-power zone 220 of a medium-power knit construction 420, high-power zone 230 of a high-power knit construction 430, and ventilation zone 240 of a ventilation knit construction 440, with transitions 202 in between. Textile fibers 114 may be any suitable type of fiber, for example, yarn, silk, acetate, nylon, polyester, rayon, flax, wool, cotton, spandex or any elastic yarn, polypropylene, or combinations thereof, and may be formed of one or more filaments (e.g., monofilament or multifilament). Textile fibers 114 may be elastic or inelastic. Elastic fibers may contribute to elasticity of performance zones 200. Elasticity of performance zones 200 including only inelastic fibers may rely on stitch types used therein for elasticity. All textile fibers 114 in seamless panels 110 may be of the same type, but need not be. Textile fibers 114 may be selected for their properties individually or in combination with other types of fibers. For example, nylon may be selected for its high strength, durability, abrasion resistance, elongation, and/or resistance to chemicals, mold, and mildew, relative to other fiber types. Also for example, spandex may be selected for its high strength and elasticity, relative to other fiber types.

Figure 5:
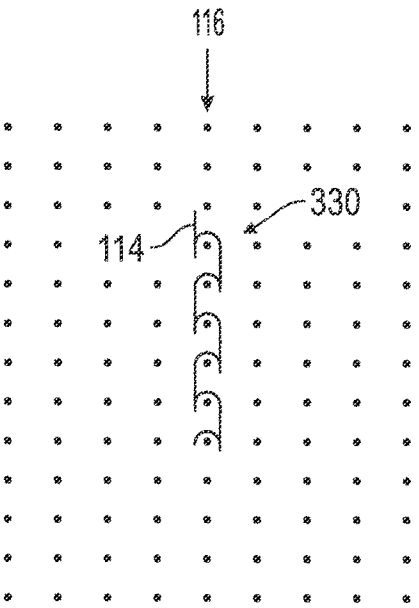
FIGS. 3-5 illustrate exemplary basic stitch types according to embodiments presented herein.
Figure 4:
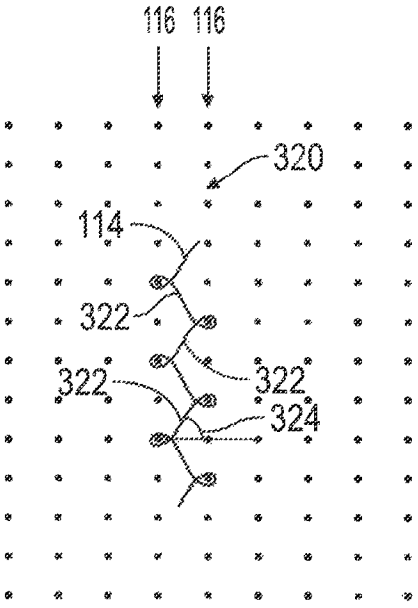
Figure 3:
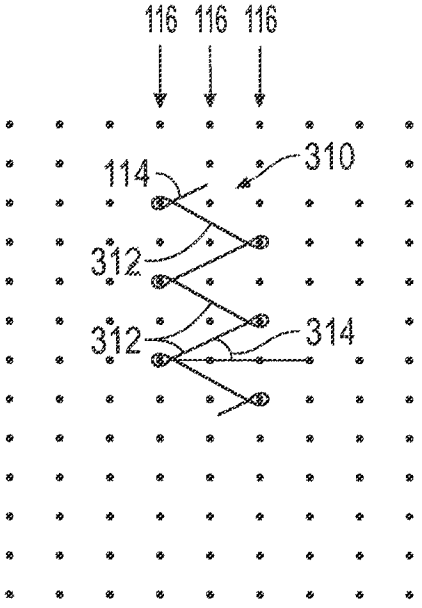

Different knit constructions can be formed from different basic stitch types and combinations thereof. For example, a first basic warp-knit stitch type 310 (see FIG. 3, depicting an exemplary 2×1 lap stitch) may have a first basic stitch underlap 312 spanning three wales 116, and may have a first basic stitch angle 314 (i.e., angle of first basic stitch underlap 312). An underlap is the segment of textile fiber 114 extending between successive stitches of the fiber in the lapping on the technical back of a warp-knitted material. A second basic warp-knit stitch type 320 (see FIG. 4, depicting an exemplary 1×1 lap stitch) may have a second basic stitch underlap 322 spanning two wales 116, and may have a second basic stitch angle 324 (i.e., angle of second basic stitch underlap 322). Second basic stitch angle 324 may be greater than first basic stitch angle 314. A third basic warp-knit stitch type 330 (see FIG. 5, depicting an exemplary open pillar stitch) may lack a connecting underlap, and so may span a single wale 116. Other stitch types not explicitly described herein may also be used with embodiments of the present invention (e.g., a 3×1 lap stitch, a 4×1 lap stitch, etc.).

Figure 6:
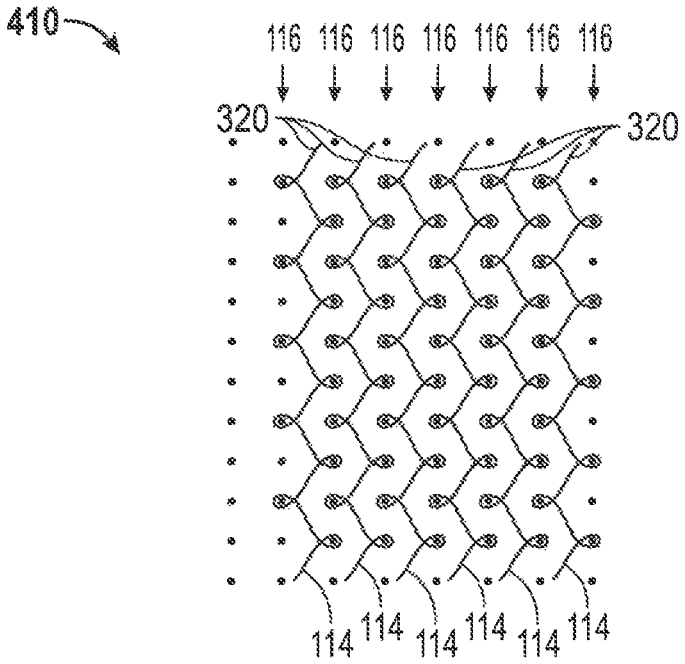
FIGS. 6-9 illustrate exemplary knit constructions according to embodiments presented herein.

In some embodiments, low-power knit construction 410 is formed entirely of textile fibers 114 forming second basic stitch type 320 (see FIG. 6). This pattern may repeat throughout low-power zone 210.

Figure 7:
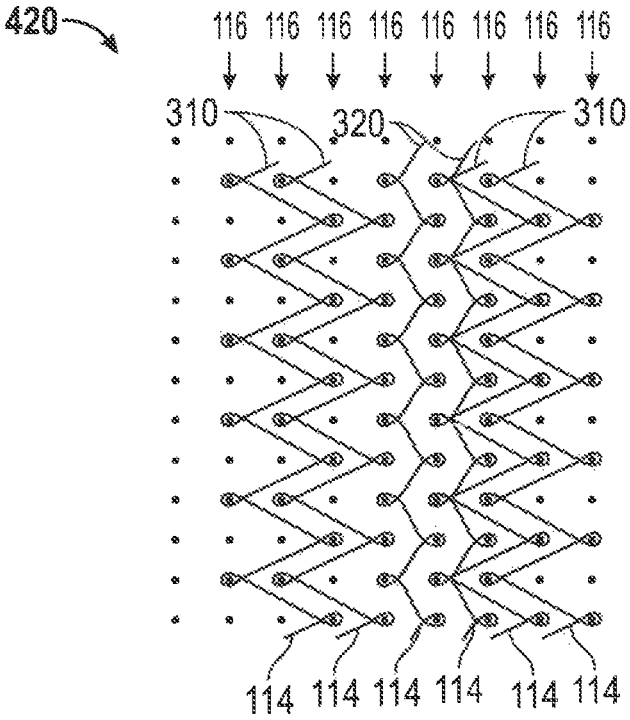

In some embodiments, medium-power knit construction 420 is formed of textile fibers 114 forming first basic stitch type 310 and textile fibers 114 forming second basic stitch type 320 in about a 2:1 ratio. For example, in FIG. 7, a pair of textile fibers 114 forming second basic stitch type 320 are disposed between pairs of textile fibers 114 forming first basic stitch type 310. This pattern may repeat throughout medium-power zone 220.

Figure 8:
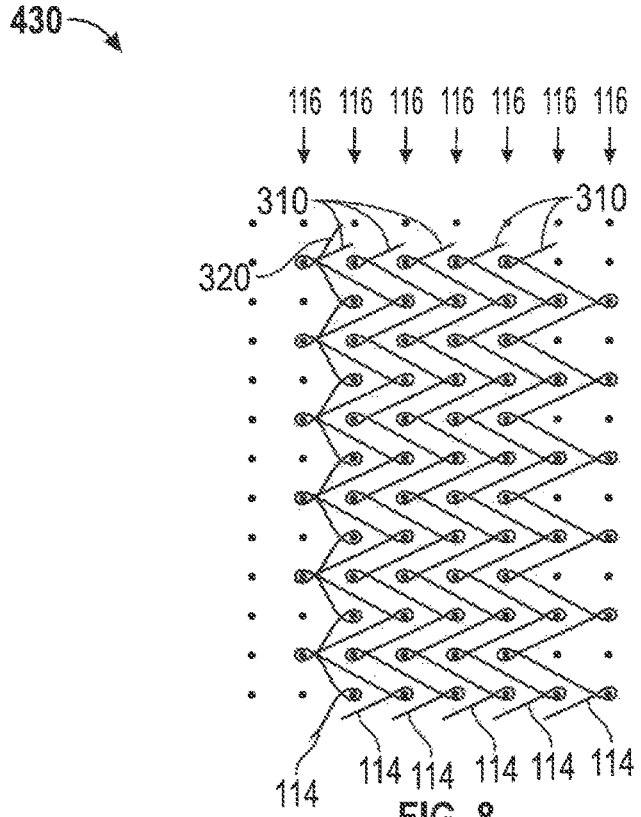

In some embodiments, high-power knit construction 430 is formed of textile fibers 114 forming first basic stitch type 310 and textile fibers 114 forming second basic stitch type 320 in about a 5:1 ratio. For example, in FIG. 8, five consecutive textile fibers 114 forming first basic stitch type 310 are disposed adjacent a single textile fiber 114 forming second basic stitch type 320. This pattern may repeat throughout high power zone 230.

Figure 9:
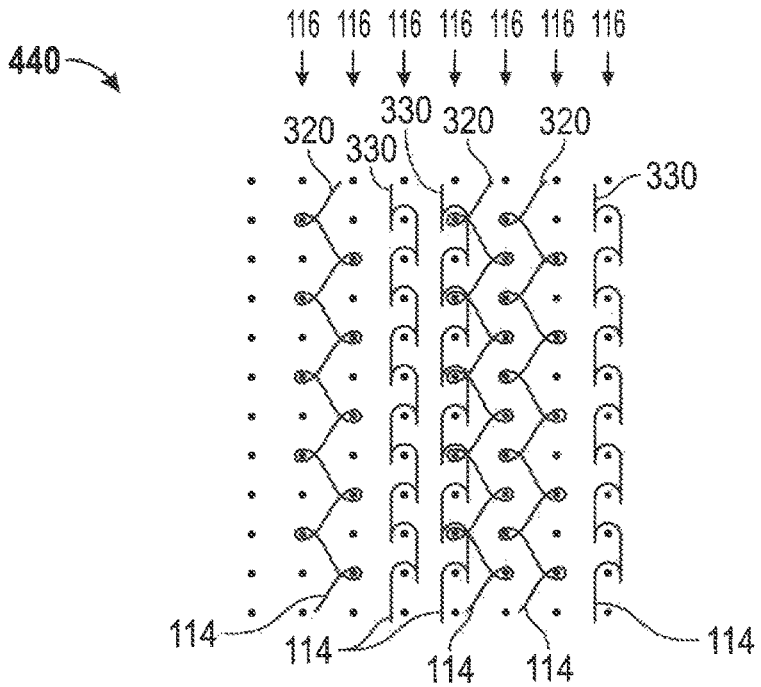

In some embodiments, ventilation knit construction 440 is formed of textile fibers 114 forming second basic stitch type 320 and textile fibers 114 forming third basic stitch type 330 in about a 1:1 ratio. For example, in FIG. 9, a single textile fiber 114 forming second basic stitch type 320 is disposed adjacent a pair of textile fibers 114 forming third basic stitch type 330 that are disposed adjacent a pair of textile fibers 114 forming second basic stitch type 320 that are disposed adjacent a single textile fiber 114 forming third basic stitch type 330. This pattern may repeat throughout ventilation zone 240.

The present invention is not limited to the particular knit constructions or combinations depicted, but can be applied to other knit constructions not explicitly described herein in some embodiments of the present invention.

Knit constructions may change at interfaces 202 between performance zones 200, and may maintain continuity of textile fibers 114 from one performance zone 200, across transition 202, to an adjacent performance zone 200, as shown, for example, in FIG. 10. FIG. 10 shows continuous textile fibers 114 spanning low-power zone 210, medium-power zone 220, high-power zone 230, and ventilation zone 240. Transitions 202 between adjacent performance zones 200 need not be straight across wales 116 as shown in FIG. 10, but may alternatively or additionally transition at various angles across wales 116 to form performance zones 200 of varying shapes and sizes, as shown, for example, in FIGS. 1 and 2.

Different basic stitches and combinations thereof may impart different performance characteristics to different performance zones 200. For example, selection of basic stitches may influence the modulus of a performance zone 200. Modulus is a measure of power in textile fabrics in the cross direction (i.e., perpendicular to the warp direction). For example, it can be characterized as tensile stress of a fabric at a selected elongation (e.g., 40% elongation). A higher modulus corresponds to higher power and compression of a performance zone 200.

In some embodiments, different basic stitches may have different underlap lengths in the lapping between wales 116. A longer straight underlap in the lapping between wales 116 may contribute to a higher modulus, thereby contributing higher power and higher compression to a performance zone 200. A shorter straight underlap in the lapping between wales 116 may contribute to a lower modulus, thereby contributing lower power and lower compression to a performance zone 200. For example, first basic stitch type 310 may have a longer underlap between wales 116 and higher modulus than second basic stitch type 320.

Further, different basic stitches may have different stitch angles. A smaller stitch angle may contribute to a higher modulus, thereby contributing higher power and higher compression to a performance zone 200. A larger stitch angle may contribute to a lower modulus, thereby contributing lower power and lower compression to a performance zone 200. For example, first basic stitch type 310 may have a smaller stitch angle and higher modulus than second basic stitch type 320.

Further, different basic stitches can be used in combination within a textile part or portion (e.g., seamless panel 110), and their ratios can affect characteristics of the textile part or portion as a function of their component properties (e.g., underlap length and angle). For example, the greater the proportion of first basic stitch type 310 to second basic stitch type 320 in a fabric part or portion, the higher the overall modulus of the fabric part or portion (and the greater its power and compression properties), all else being equal. Also for example, the greater the proportion of first basic stitch type 310 to second basic stitch type 320 in a fabric part or portion, the denser and heavier the fabric part or portion may become due to the relatively higher yarn consumption in the underlap, all else being equal.

Different performance zones 200 may include different ratios of first basic stitch type 310, second basic stitch type 320, third stitch type 330, and other stitch types to achieve desired performance characteristics. For example, low-power zone 210 may have a shorter average underlap between wales 116 than medium-power zone 220, such that medium-power zone 220 has a higher modulus than low-power zone 210. This may be attributable to a greater proportion of stitch types having a shorter underlap between wales 116 in low-power zone 210. For example, as shown in the exemplary low-power knit construction 410 of FIG. 6 and medium-power knit construction 420 of FIG. 7, low-power knit construction 410 includes 100% second basic stitch type 320, and medium-power knit construction 420 includes 33% second basic stitch type 320 and 67% first basic stitch type 310. Since second basic stitch underlap 322 between wales 116 is shorter than first basic stitch underlap 312 between wales 116, low-power knit construction 410 may have a lower modulus than medium-power knit construction 420, due to its relatively higher proportion of second basic stitch type 320.

Also for example, medium-power zone 220 may have a shorter average underlap between wales 116 than high-power zone 230, such that high-power zone 230 has a higher modulus than both low-power zone 210 and medium-power zone 220. This may be attributable to a greater proportion of stitch types having a shorter underlap between wales 116 in low-power zone 210 and medium-power zone 220 than in high-power zone 230. For example, as shown in the exemplary high-power knit construction 430 of FIG. 8, high-power knit construction 430 includes 17% second basic stitch type 320 and 83% first basic stitch type 310. Since second basic stitch underlap 322 between wales 116 is shorter than first basic stitch underlap 312 between wales 116, low-power knit construction 410 and medium-power knit construction 420 may have lower moduli than high-power knit construction 430, due to their relatively higher proportions of second basic stitch type 320.

Also for example, low-power zone 210 may have a larger average stitch angle than medium-power zone 220, such that medium-power zone 220 has a higher modulus than low-power zone 210. This may be attributable to a greater proportion of stitch types having a larger stitch angle in low-power zone 210. Since second basic stitch angle 324 is larger than first basic stitch angle 314, the exemplary low-power knit construction 410 of FIG. 6 may have a lower modulus than the exemplary medium-power knit construction 420 of FIG. 7, due to its relatively higher proportion of second basic stitch type 320.

Also for example, medium-power zone 220 may have a larger average stitch angle than high-power zone 230, such that high-power zone 230 has a higher modulus than both low-power zone 210 and medium-power zone 220. This may be attributable to a greater proportion of stitch types having a larger stitch angle in low-power zone 210 and medium-power zone 220 than in high-power zone 230. Since second basic stitch angle 324 is larger than first basic stitch angle 314, low-power knit construction 410 and medium-power knit construction 420 may have lower moduli than high-power knit construction 430, due to their relatively higher proportions of second basic stitch type 320.

In some embodiments, knitted garment 100 may include one or more ventilation zones 240, to facilitate airflow and cooling of a wearer. A ventilation stitch type may be incorporated into any of the previously-described knit constructions or other knit construction. For example, a ventilation knit construction 440 may include third basic stitch type 330, which may be a ventilation stitch type. In some embodiments, third basic stitch type 330 may include no connecting underlap between wales, to facilitate airflow by avoiding airflow impedance due to underlap between wales. For example, as shown in the exemplary ventilation knit construction 440 of FIG. 9, ventilation knit construction 440 includes 50% third basic stitch type 330, thereby facilitating airflow and ventilation through the textile material of ventilation zones 240 formed of ventilation knit construction 440. Ventilation knit construction 440 may include a greater proportion of third basic stitch type 330 to increase ventilation properties of ventilation knit construction 440, or may include a lesser proportion of third basic stitch type 330 to decrease ventilation properties of ventilation knit construction 440.

Knit construction of a performance zone 200 may include a greater or lesser proportion of first basic stitch type 310 to increase or decrease, respectively, the modulus of the performance zone 200. Knit construction of a performance zone 200 may include a greater or lesser proportion of second basic stitch type 320 to decrease or increase, respectively, the modulus of the performance zone 200. Knit construction of a performance zone 200 may include a greater or lesser proportion of third basic stitch type 330 to increase or decrease, respectively, ventilation of the performance zone 200. Other stitch types may be included in knit construction of a performance zone 200 instead of or in addition to basic stitch types described herein. First basic stitch type 310 and second basis stitch type 320 are described herein in terms of their relative properties (e.g., underlap length between wales, stitch angle) as they contribute to performance characteristics of performance zones 200, and are not limited to the specific stitches depicted in the figures. Third basic stitch type 330 is described herein in terms of its ventilation properties as they contribute to ventilation of performance zones 200, and is not limited to the specific stitch depicted in the figures.

Knitted garment 100 may be designed to include various combinations of different basic stitches at various locations relative to an intended wearer's body. These combinations can be used to define areas having different properties located throughout the garment to suit the design of a garment designer (e.g., performance zones 200). For example, the designer may define stitch combinations to create a high-power, high-density, heavy-weight zone (e.g., high-power zone 230), a low-power, low-density, light-weight zone (e.g., low-power zone 210), a medium-power, medium-density, medium-weight zone (e.g., medium-power zone 220), or a high-ventilation zone (e.g., ventilation zone 240). The sizes, shapes, numbers, and types of performance zones 200 may be varied to suit the desires of a designer, and are not limited to those depicted.

The designer may define the desired garment construction including stitch types, knit constructions, and/or performance zones (including, for example, the exemplary constructions described herein), and may transfer the stitch structures for knitted garment 100 into knitting electronic files. A knitting machine may then be programmed using the knitting electronic files to knit each seamless panel 110 of knitted garment 100 seamlessly into a single piece of fabric. Each seamless panel 110 may be cut from the single piece of fabric (e.g., when laid flat, see FIG. 2) and sewn together into the finished knitted garment 100 (see FIG. 1).

The foregoing description of the specific embodiments of the warp-knitted athletic performance garment described with reference to the figures will so fully reveal the general nature of the invention that others can, by applying knowledge within the skill of the art, readily modify and/or adapt for various applications such specific embodiments, without undue experimentation, without departing from the general concept of the present invention.

Figure 12A:
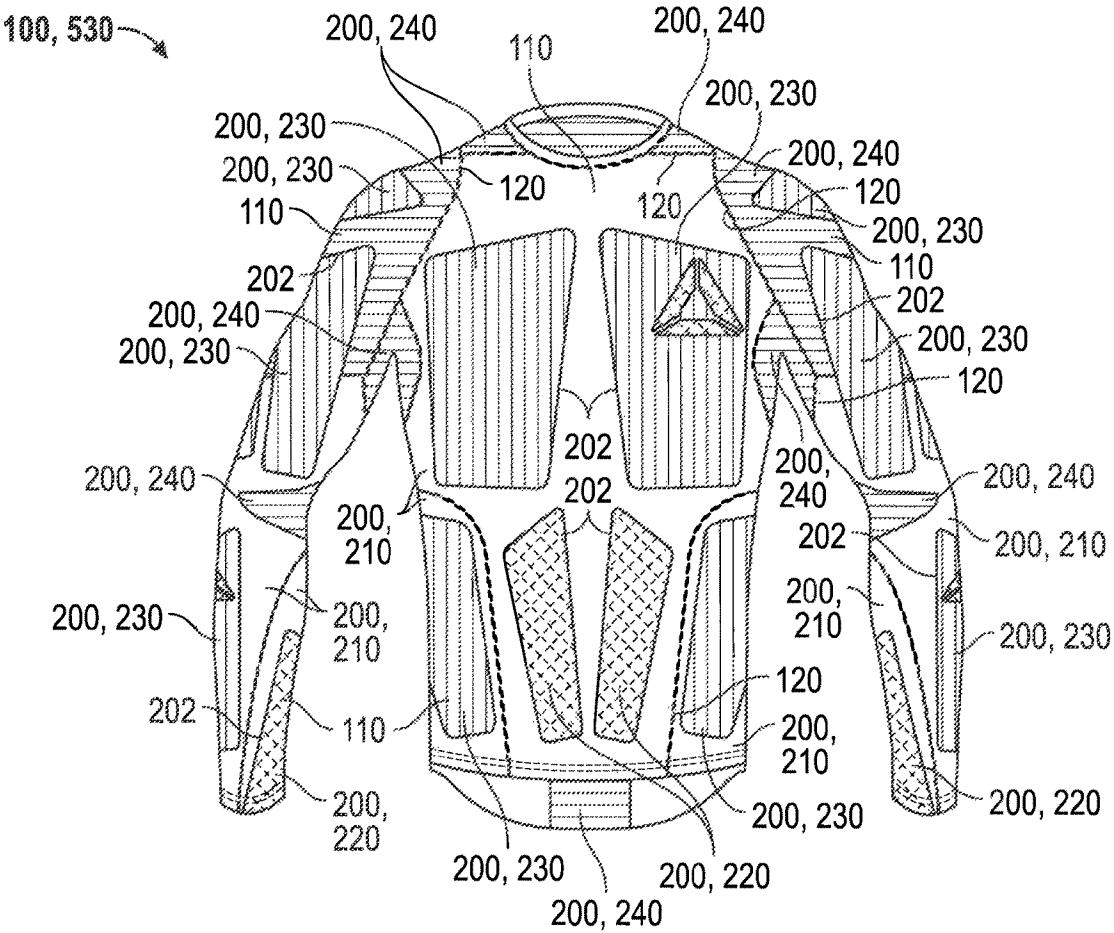
FIG. 12A illustrates a front view of a knitted athletic performance garment, according to embodiments presented herein.
Figure 12B:
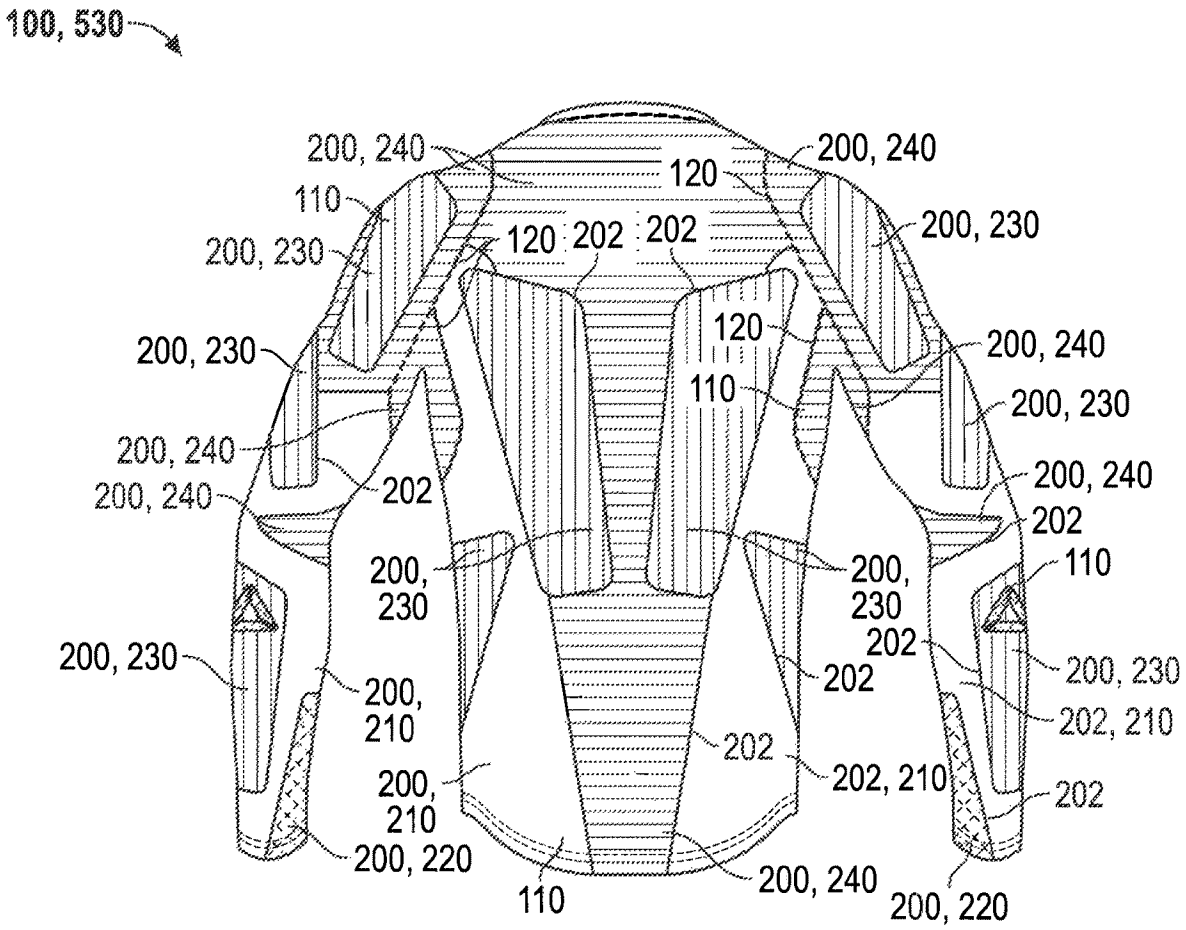
FIG. 12B illustrates a rear view of the knitted athletic performance garment of FIG. 12A, according to embodiments presented herein.
Figure 13A:
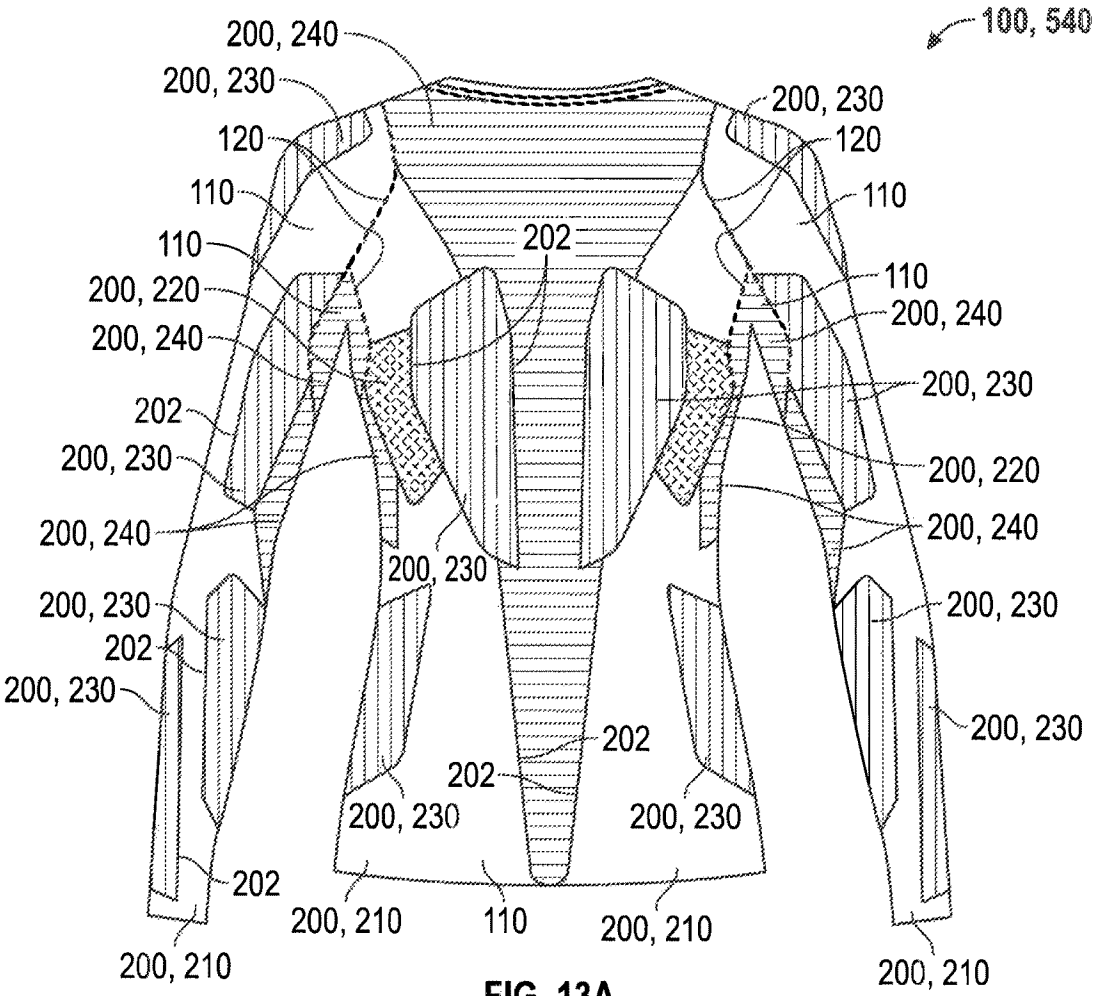
FIG. 13A illustrates a rear view of a knitted athletic performance garment, according to embodiments presented herein.
Figure 13B:
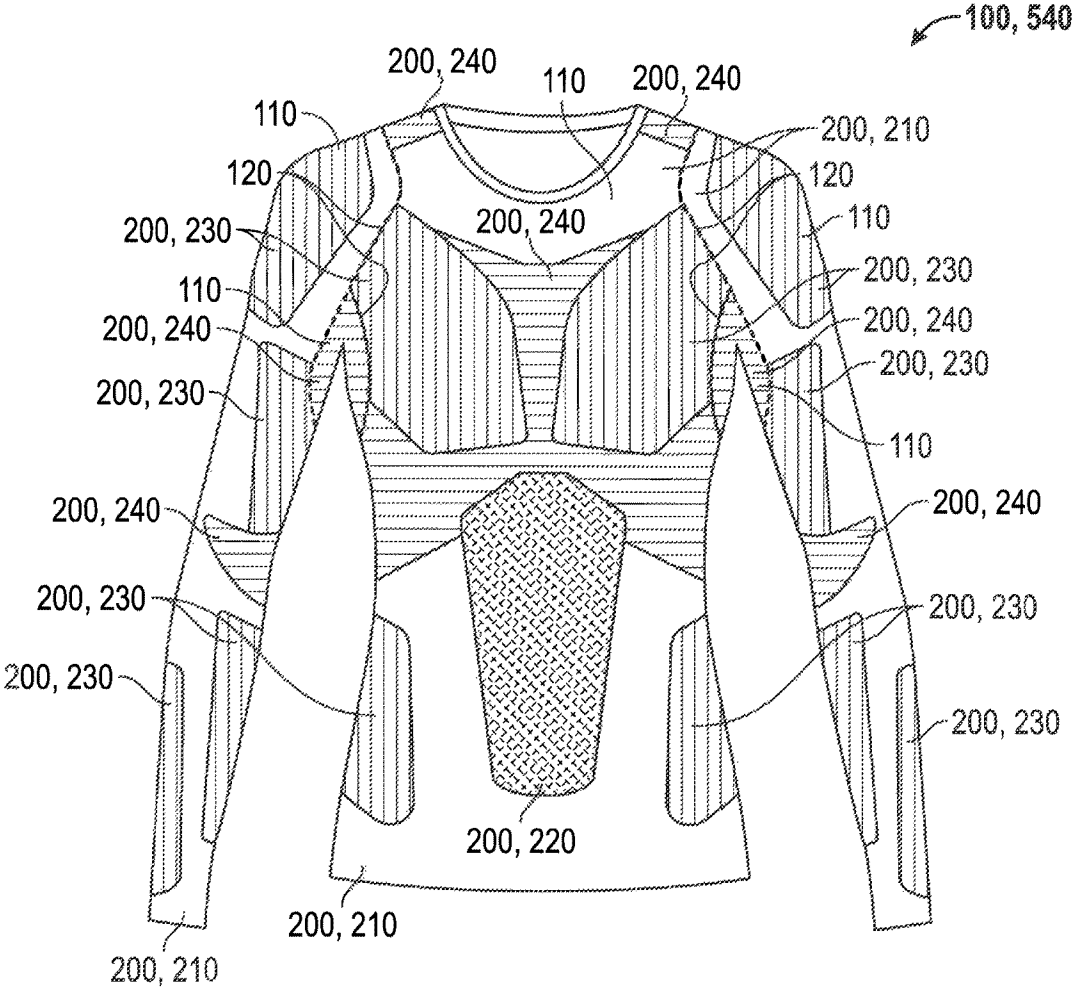
FIG. 13B illustrates a front view of the knitted athletic performance garment of FIG. 13A, according to embodiments presented herein.

While various embodiments of the present invention have been described above, they have been presented by way of example only, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and Scope of the present invention. For example, the embodiments discussed above related to athletic performance pants, but the principles of the invention are generally applicable to and readily useable with all types of garments, including shirts (e.g., shirt 530 of FIGS. 12A. 12B or shirt 540 of FIGS. 13A and 13B), bras, hats, socks, gloves, vests, shorts, arm sleeves, leg sleeves (e.g., leg sleeves 550 of FIGS. 14A and 14B) etc. The elements of the embodiments presented above are not necessarily mutually exclusive, but may be interchanged to meet various needs as would be appreciated by one of skill in the art.

It is to be understood that the phraseology or terminology used herein is for the purpose of description and not of limitation. The breadth and scope of the present invention should not be limited by any of the above-described exemplary embodiments, but should be defined only in accordance with the following claims and their equivalents.

What is claimed is:

1. A knitted athletic performance garment, comprising:

a seamless panel to cover a portion of a wearer's body; and a first performance zone and a second performance zone formed in the seamless panel, wherein the first performance zone is formed of a first warp knit stitch construction and has a first modulus of elasticity, wherein the second performance zone is formed of a second warp knit stitch construction and has a second modulus of elasticity, wherein the first warp knit stitch construction is different from the second warp knit stitch construction, wherein the first modulus of elasticity is different from the second modulus of elasticity, wherein the difference in modulus of elasticity between the first performance zone and the second performance zone is due to the difference in stitch construction between the first performance zone and the second performance zone, wherein the first warp knit stitch construction and the second warp knit stitch construction each comprise a first stitch type and a second stitch type different than the first stitch type, and wherein the ratio of the first stitch type to the second stitch type in the second knit stitch construction is greater than the ratio of the first stitch type to the second stitch type in the first knit stitch construction.

2. The athletic performance garment of claim 1, wherein the panel is knit in a flat pattern.

3. The athletic performance garment of claim 1, wherein the panel is capable of being laid flat before incorporation into the garment.

4. The athletic performance garment of claim 1, wherein textile fiber of the first performance zone is the same as textile fiber of the second performance zone.

5. The athletic performance garment of claim 1, wherein a textile fiber of the panel extends continuously from within the first performance zone to within the second performance zone, wherein the textile fiber defines the first stitch type in the first performance zone and the second stitch type in the second performance zone.

6. An athletic performance garment, comprising:

a knitted high-compression zone having a high-compression knit construction; and a knitted low-compression zone having a low-compression knit construction, wherein the high-compression zone and low-compression zone are seamlessly formed together in a flat pattern, and wherein an average underlap of the high-compression zone is longer than an average underlap of the low-compression zone.

7. The athletic performance garment of claim 6, comprising:

a knitted medium-compression zone having a medium-compression knit construction, wherein the medium-compression zone is seamlessly formed together with the high-compression zone and the low-compression zone, wherein an average underlap of the medium-compression zone is shorter than the average underlap of the high-compression zone and longer than the average underlap of the low-compression zone.

8. The athletic performance garment of claim 6, wherein at least one of the high-compression knit construction and the low-compression knit construction comprises a first stitch type and a second stitch type, wherein the first stitch type has a longer underlap than the second stitch type.

9. The athletic performance garment of claim 6, wherein the high-compression knit construction is a warp knit construction, and wherein the low-compression knit construction is a warp knit construction.

10. An athletic performance garment, comprising:

a knitted high-compression zone having a high-compression knit construction; and a knitted low-compression zone having a low-compression knit construction, wherein the high-compression zone and low-compression zone are seamlessly formed together in a flat pattern, and wherein an average stitch angle relative to a reference axis of the high-compression zone is smaller than an average stitch angle relative to the reference axis of the low-compression zone.

11. The athletic performance garment of claim 10, comprising:

a knitted medium-compression zone having a medium-compression knit construction, wherein the medium-compression zone is seamlessly formed together with the high-compression zone and the low-compression zone, wherein an average stitch angle relative to the reference axis of the medium-compression zone is larger than the average stitch angle relative to the reference axis of the high-compression zone and smaller than the average stitch angle relative to the reference axis of the low-compression zone.

12. An athletic performance garment, comprising:

a knitted high-compression zone having a high-compression knit construction;

a knitted low-compression zone having a low-compression knit construction; and a knitted ventilation zone having a ventilation knit construction, wherein the high-compression zone and low-compression zone are seamlessly formed together in a flat pattern, wherein an average underlap of the high-compression zone is longer than an average underlap of the low-compression zone, wherein the ventilation zone is seamlessly formed together with the high-compression zone and the low-compression zone, and wherein the ventilation zone includes at least two wales having no connecting underlap therebetween.

13. The athletic performance garment of claim 12, wherein the ventilation zone includes at least two wales having a connecting underlap therebetween.

14. The athletic performance garment of claim 13, wherein the length of the connecting underlap of the ventilation zone is approximately equal to the length of the shortest connecting underlap of the low-compression zone.

15. The athletic performance garment of claim 1, wherein the ratio of the first stitch type to the second stitch type in the first knit stitch construction is 2:1.

16. The athletic performance garment of claim 1, wherein the ratio of the first stitch type to the second stitch type in the second knit stitch construction is 5:1.

17. The athletic performance garment of claim 1, wherein each textile fiber in the first warp knit stitch construction only defines one stitch type in the first performance zone.

18. The athletic performance garment of claim 17, wherein each textile fiber in the second warp knit stitch construction only defines one stitch type in the second performance zone.

* * * * *